United States Patent [19]

Shaffer et al.

[11] 4,372,210

[45] Feb. 8, 1983

[54] PYROTECHNIC CAP WITH MECHANICALLY DESENSITIZED COMPOSITION

[75] Inventors: John W. Shaffer; Thomas L. Gavenonis, both of Williamsport, Pa.

[73] Assignee: GTE Products Corporation, Stamford, Conn.

[21] Appl. No.: 2,264

[22] Filed: Jan. 10, 1979

[51] Int. Cl.[3] ..... C06C 7/00

[52] U.S. Cl. ..... 102/204; 116/4; 149/29

[58] Field of Search ..... 116/4, 5, 7; 102/27 R, 102/29; 149/29, 31

[56] References Cited

U.S. PATENT DOCUMENTS

| | | | |
|---|---|---|---|
| 562,426 | 6/1896 | Schwiening | 149/31 |
| 2,658,874 | 11/1953 | Clay et al. | 149/29 X |
| 3,607,472 | 9/1971 | Douda | 149/29 X |
| 3,765,334 | 10/1973 | Rentz et al. | 102/27 R |
| 3,774,541 | 11/1973 | Bratton | 102/27 R |
| 4,130,082 | 12/1978 | Bouchard et al. | 116/5 |

FOREIGN PATENT DOCUMENTS 7256 of 1891 United Kingdom ..... 149/29

OTHER PUBLICATIONS

Publ. Encyclopedia of Explosive and Related Items, Basil T. Federoff et al., Picatinny Arsenal, Dover, New Jersey, AD 653029, vol. 3, 1966 (pp. D88–90).

*Primary Examiner*—Daniel M. Yasich
*Attorney, Agent, or Firm*—Lawrence R. Fraley

[57] ABSTRACT

An improved pyrotechnic cap which includes a plastic container having a quantity of pyrotechnic composition hermetically sealed therein. The cap is capable of being ignited by the radiant energy from an adjacent flashlamp to provide an audible signal of high intensity (e.g. 158 to 164 decibels at 25 centimeters). The improvement constitutes providing the composition with a quantity of desensitizing material (e.g. powdered polyethylene) which significantly decreases the cap's sensitivity to ignition by mechanical impact or crushing.

4 Claims, 1 Drawing Figure

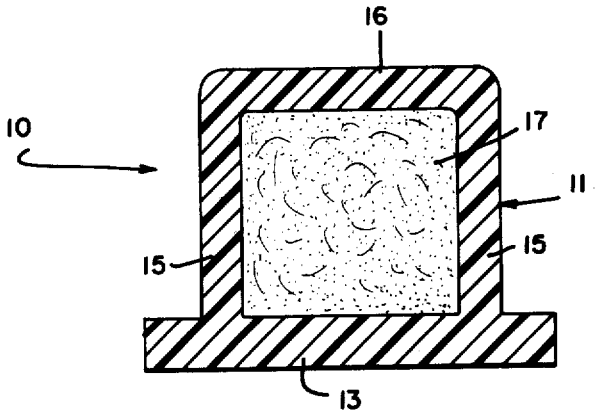
16
10
17
11
15
15
13

PYROTECHNIC CAP WITH MECHANICALLY DESENSITIZED COMPOSITION

CROSS REFERENCE TO COPENDING APPLICATIONS

An application under Ser. No. 2,263, entitled "Heat-Sealed Pyrotechnic Cap and Method of Making" (Inventors: A. C. Bouchard et al), describes a method for providing a hermetic seal in the end of a plastic cap containing a quantity of radiant energy activated pyrotechnic material therein. The formed cap may include a nonreactive filler located therein separate from and atop the pyrotechnic material to serve as a support for the sealed end.

An application under Ser. No. 2,265, entitled "Radiant Energy Activated Pyrotechnic Cap Having Desiccant Therein" (Inventor: J. W. Shaffer), describes a pyrotechnic cap which includes a nondeliquescent desiccant to absorb any moisture which may exist within the cap after hermetic sealing thereof.

An application under Ser. No. 2,272, entitled "Pyrotechnic Cap With Moisture Indicator" (Inventors: A. C. Bouchard et al), describes a pyrotechnic cap which is provided with a color-changing member to indicate the presence of moisture inside the sealed cap.

The above applications were filed Jan. 10, 1979 and are assigned to the assignee of the present invention.

In addition to the above, U.S. Pat. No. 4,130,082, entitled "Flashlamp Assembly For Providing Highly Intense Audible and Visual Signals" (Inventors: A. C. Bouchard et al) was filed June 6, 1977 and describes a hermetically-sealed pyrotechnic cap adapted for being activated by the light and/or heat from a chemical flashlamp. U.S. Pat. No. 4,130,082 is also assigned to the same assignee as the instant invention.

BACKGROUND OF THE INVENTION

The invention relates to pyrotechnic caps and particularly to hermetically-sealed pyrotechnic caps capable of being activated by radiant energy in the form of light and/or heat.

In the aforementioned U.S. Pat. No. 4,130,082, there is described a unique concept in the production of substantially simultaneous high intensity audible and visual signals. As described therein it has been discovered that hermetically sealed plastic caps having a pyrotechnic composition therein can be instantaneously and reliably activated by the highly intense light from an adjacent chemical flashlamp to produce an audible signal also of high intensity (e.g. approaching 165 decibels). By chemical flashlamp is meant one having a light-transmitting (e.g. glass) envelope which includes a combustion-supporting atmosphere and a quantity of combustible material (e.g. zirconium) therein. The preferred activating flashlamps are those presently utilized in the photoflash product manufactured and sold by the assignee of the instant invention under the name "MAGICUBE". As described in U.S. Pat. No. 4,130,082, it is also possible to activate the sealed caps using other varieties of flashlamps such as those which are electrically activated. One example of this latter type are the flashlamps currently utilized in the photoflash product manufactured and sold by the assignee of the instant invention under the name "FLIPFLASH". A primary use for the above device is as an intrusion alarm. The device may also comprise part of an alarm system wherein a suitable detector is used to receive the device's output and thereafter perform an auxiliary function (e.g. emit a prolonged, high intensity signal).

A well-known characteristic of pyrotechnic compositions is that such materials are readily capable of being mechanically activated (e.g. by impact or crushing). In fact, many manufacturers have taken steps to increase the mechanical sensitivity of their compositions in view of the intended use of such products. For example, toy cap manufacturers have added quantities of sand to their compositions to reduce the impact necessary to provide cap ignition. The hard, abrasive sand serves to grind the mixture during said impact. In similar fashion, the producers of pyrotechnic compositions for such use as primers in percussively-actuated flashlamps have added metal particles to their compositions.

As described above, it has been found that many pyrotechnic compositions, when hermetically sealed in a suitable container and located near a flashlamp, can be successfully ignited by the radiant energy from said flashlamp. When used in this manner, it is understood that mechanical activation is not necessary for ignition of the respective cap members. It is also readily understood that in many instances (e.g. shipping, storage, etc.), it is highly desirable to reduce the mechanical sensitivity of such products. Heretofore, methods of accomplishing such a feat have been nonexistent.

It is believed, therefore, that a cap member having a pyrotechnic composition capable of being readily ignited by radiant energy from a flashlamp and also substantially desensitized to mechanical actuation in comparison to pyrotechnic products of the prior art would constitute a significant advancement in this art.

OBJECTS AND SUMMARY OF THE INVENTION

It is, therefore, a primary object of the present invention to provide a pyrotechnic cap having reduced mechanical sensitivity.

In accordance with one aspect of the invention, there is provided an improved pyrotechnic cap which is capable of providing a high intensity audible signal when activated by the radiant energy from an adjacent flashlamp. The cap includes a plastic container with a quantity of pyrotechnic composition sealed therein. The improvement comprises adding, as part of the composition, a quantity of desensitizing material which has the effect of substantially increasing the mechanical force necessary to activate the cap.

BRIEF DESCRIPTION OF THE DRAWING

The drawing is an elevational view, in section, of a pyrotechnic cap member in accordance with a preferred embodiment of the invention.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawings.

With particular reference to the drawing, there is shown a pyrotechnic cap member 10 which comprises a plastic container 11 which in cross-section includes a base portion 13, at least two upstanding sides 15, and a hermetically-sealed end portion 16. (One method of providing container 11 with sealed end 16 is described in copending application under Ser. No. 2,263). The plastic material for container 11 is a thermoplastic, preferably high density polyethylene. It is understood, however, that other plastics could be used, including low density polyethylene, polypropylene, polyvinyl chloride, polycarbonates, etc. The container as shown is preferably cylindrical in configuration but could, of course, assume other shapes, including rectangular, hexagonal, etc.

Cap 11 is shown as including a quantity of pyrotechnic composition 17 which is hermetically sealed within container 11. With regard to the present invention, the term composition is meant to define a product of mixing or combining various materials, elements, or ingredients. Accordingly, composition 17 is the combination (or mixture) of pyrotechnic material capable of being readily activated by the application of mechanical force with a material which significantly desensitizes the combined product. With added regard to the invention, by a desensitizing material is meant one which, when combined with the described pyrotechnic materials, will substantially increase the average mechanical firing force necessary to activate the sealed cap member. For purposes of the invention, a minimum increase of at least ten percent is deemed significant. By average is meant the combined test results of a minimum of ten caps. It was found, quite unexpectedly, that the above distinctly advantageous feature was capable of attainment without adversely affecting the desired functioning reliability of the cap or the high intensity audible signal therefrom. Examples of suitable pyrotechnic materials for use in the instant invention are described in the aforementioned U.S. Pat. No. 4,130,082. A preferred material is one containing potassium chlorate, red phosphorous, manganese dioxide, and a dispersing agent. Pyrotechnic materials known as "Armstrong's Mixtures" may also be used with the present invention. These compositions typically include potassium chlorate within the range of about 67 to 81 percent, phosphorous from about 8 to 27 percent, sulfur from about 3 to 9 percent, and precipitated chalk from about 3 to 11 percent. All of these percentages are by weight of the material.

As an alternate embodiment, it may be desirable to use a pyrotechnic mixture which emits a "whistling" or similar sound. Such materials are well known in the art and may contain potassium chlorate, potassium perchlorate, potassium nitrate, red gum, gallic acid, potassium picrate, potassium benzoate, potassium dinitrophenate and sodium salicylate. These formulations are shown on pages 376 and 377 of the book entitled "Military and Civilian Pyrotechnics" by Dr. Herbert Ellern, copyright 1968 by The Chemical Publishing Co., Inc. The aforementioned "Armstrong's Mixtures" are defined on page 353 of this text.

The above nonwhistling materials assure an audible signal of high intensity when the cap is activated by the energy from an adjacent flashlamp. By high intensity is meant an output of about 85 dicibels measured at a distance of 25 centimeters. The preferred range, when cap 11 is utilized in the aforedescribed manner, is from about 158 to about 164 decibels at this distance.

As stated, a quantity of desensitizing material was added to the above materials to produce a composition having a substantially decreased sensitivity to mechanical activation. The preferred material was powdered polyethylene having a particle size equal to or less than 20 micrometers, said material comprising approximately five percent (by weight) of the total composition. Powdered polyethylene is ideal because the particles of this material are soft, readily-distortable, and thereby assure a substantial reduction of friction when combined with impact-sensitive elements. It is believed that the polyethylene decreases the grinding action of particles within the composition when the composition is exposed to mechanical impact or crushing. This in turn decreases the formation of, as well as mutual contact between, nascent surfaces of certain elements of the pyrotechnic material. Powdered polyethylene is further preferred because it possesses the following, added properties:

1. Noninterfering with the radiant energy activation of the cap member;
2. Chemically compatible with the composition ingredients;
3. Clean (does not give rise to odor formation or the production of discoloring smoke which might produce smudges, etc. on surfaces proximate the cap member);
4. Nontoxic; and
5. Resistant to prolonged burning so as not to serve as a combustion transfer agent for other materials proximate the cap member.

It is also preferred to utilize low density powder to prevent the ejection of damage-promoting projectiles upon ignition of the sealed composition. With still further regard to the invention, it is believed necessary that the particle size of the powdered additive be equal to or smaller than that of the pyrotechnic material combined therewith. In one example, the powdered polyethylene had a particle size of about 20 micrometers while that of the corresponding pyrotechnic material was about 44 micrometers. It is believed that the above relationship further reduces the possibility of frictional conversion into heat, thus causing cap ignition.

It is to be understood that the present invention is not limited to the use of polyethylene powder. Other plastic powders can also be used, including polypropylene and Teflon. In addition, graphite, natural or synthetic wax powders, or paraffin may be employed, as well as the powders of nonhygroscopic metallic soaps such as aluminum or calcium stearate. To enhance the reliability of radiant energy activation, dark-colored powders such as molybdenum disulfide may be successfully used. It is also possible to add a darkening agent (e.g. carbon black, organic pigments, etc.) to the above nondark powders to assure this advantageous feature. Understandably, darker materials will absorb the activating radiant energy at a greater rate than those of the nondarkened (e.g. white) variety.

It is possible to produce functional pyrotechnic composition 17 having the following ranges:

| Ingredient | Percent by weight (dried) |
|---|---|
| Potassium chlorate | 10 to 90 |
| Red phosphorous | 5 to 70 |
| Manganese dioxide | 0 to 30 |
| Dispersant | 0 to 5 |
| Magnesium oxide | 0 to 10 |
| Sulfur | 0 to 5 |
| Wetting Agent | 0 to 5 |
| Desensitizing material | 1 to 50 |

As specific examples of the invention, several caps were made which each contained the following composition:

| Ingredient | Percent by weight (dried) |
|---|---|
| Potassium chlorate | 48.85 |
| Red phosphorous | 28.62 |
| Manganese dioxide | 11.45 |
| Dispersant | 1.55 |
| Magnesium oxide | 1.23 |
| Sulfur (precipitated) | 0.06 |
| Wetting agent | 3.48 |
| Polyethylene powder | 4.76 |

Each of the above examples contained approximately eleven milligrams of dried composition 17. In preparation, the pyrotechnic portion of the composition was deposited, in slurry form, within a cylindrical polyethylene container having a circumference of 0.457 cm and a height of 0.356 cm. This material was dried afterwhich the desensitizing polyethylene powder was added thereto. The preferred wetting agent was Tergitol anionic 08, available from the Union Carbide Corporation, New York, New York and the preferred dispersant was Marasperse C-21, available from the American Can Company, Greenwich, Conn.

In addition to the above examples, several cap members were produced each containing the above pyrotechnic composition but excluding the desensitizing material additive. All of the above members were then individually subjected to compression testing in which the members were positioned between a pair of flat plates of a hydraulic press. The press, capable of exerting a total of 890 lbs. force, was then activated to compress the cap members until ignition occurred. At the point of ignition, the gauge on the press was read and the respective cap assigned the corresponding reading.

The results obtained for the group of caps containing no desensitizing additive differed significantly from those for the desensitized members. Firstly, it was possible to achieve ignition of all nondesensitized caps, with the average ignition force approximately 352.7 lbs. Contrarily, it was only possible to ignite four of the ten caps containing the powdered polyethylene desensitizer. Assigning a value of 890 lbs. force to each of those members which failed to ignite, and combining these values with those obtained for the remaining four ignited caps, the average ignition force was approximately 650 lbs. or about 84 percent greater than the average for the nondesensitized members. Of added significance, the minimum force to achieve ignition for the nondesensitized group was about 111 lbs. while that for the four caps of the desensitized group was about 149 lbs., representing an increase of 35 percent. Understandably, the above results clearly represent a substantial improvement in the decrease in sensitivity to mechanical impact for caps containing the described additives.

It is understood that the present invention is not limited to caps containing the described eleven milligrams of composition. Caps containing quantities ranging from 2 to 25 milligrams are possible. It is further possible to include the filler members or materials described in copending application under Ser. No. 2,263 as part of the cap member. Such fillers (e.g. paper wadding) would be located atop the aforedescribed pyrotechnic compositions and thereby function in the manner defined in Ser. No. 2,263.

Thus there has been shown and described an improved pyrotechnic cap member wherein the improvement constitutes the addition of desensitizing materials to the sealed composition to significantly decrease the sealed cap's sensitivity to ignition by mechanical impact.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a pyrotechnic cap for providing an audible signal of high intensity upon receipt of energy in the form of light and/or heat from a flashlamp wherein said cap includes a plastic container having a pyrotechnic composition hermetically sealed therein separately from said flashlamp, the improvement wherein said pyrotechnic composition comprises a powdered mixture of a quantity of pyrotechnic material and a predetermined quantity of a low density, nontoxic desensitizing material having soft, readily distortable particles, the size of said particles being equal to or less than the size of the particles of said pyrotechnic material, said desensitizing material desensitizing said pyrotechnic cap against ignition by application of mechanical force thereto and not against ignition by said light and/or heat from said flashlamp.

2. The improvement according to claim 1 wherein said desensitizing material is a plastic powder selected from the group consisting of polyethylene and polypropylene.

3. The improvement according to claim 1 wherein said desensitizing material comprises from about 1 to about 50 percent by weight of said pyrotechnic composition.

4. The improvement according to claim 1 wherein said pyrotechnic composition comprises in dried form from about 10 to about 90 percent potassium chlorate, from about 5 to about 70 percent red phosphorous, from about 0 to about 30 percent manganese dioxide, from about 0 to about 5 percent of a dispersant, from about 0 to about 10 percent magnesium oxide, from about 0 to about 5 percent sulfur, from about 0 to about 5 percent of a wetting agent, and from about 1 to about 50 percent desensitizing material, all of said percentages by weight of said composition.

* * * * *